US007052417B2

(12) United States Patent
Chen

(10) Patent No.: US 7,052,417 B2
(45) Date of Patent: May 30, 2006

(54) INFLATABLE BASKETBALL STRUCTURE

(76) Inventor: Samuel Chen, Flat M, 3 Floor, Kaiser Estate Phase 3, Hok Yuen Street, Hunghom, Kowloon, Hong Kong (CN)

( * ) Notice: Subject to any disclaimer, the term of this patent is extended or adjusted under 35 U.S.C. 154(b) by 0 days.

(21) Appl. No.: 11/009,318

(22) Filed: Dec. 10, 2004

(65) Prior Publication Data

US 2005/0119073 A1 Jun. 2, 2005

Related U.S. Application Data

(62) Division of application No. 10/651,897, filed on Aug. 29, 2003, now Pat. No. 6,918,846.

(51) Int. Cl.
*A63B 63/08* (2006.01)

(52) U.S. Cl. ..... 473/479; D21/702

(58) Field of Classification Search ..... 473/479, 473/478, 476, 481, 482, 483, 487; D21/701, D21/702

See application file for complete search history.

(56) References Cited

U.S. PATENT DOCUMENTS

| | | | | | |
|---|---|---|---|---|---|
| 2,939,707 | A | * | 6/1960 | Lemelson | 273/402 |
| D353,641 | S | * | 12/1994 | Liu | D21/702 |
| D360,667 | S | * | 7/1995 | Liu | D21/703 |
| 5,546,707 | A | * | 8/1996 | Caruso | 52/2.13 |
| D410,714 | S | * | 6/1999 | Sherwood et al. | D21/701 |
| 5,944,623 | A | * | 8/1999 | Schlicting | 473/489 |
| D433,471 | S | * | 11/2000 | Hsu et al. | D21/701 |
| 2005/0049090 | A1 | * | 3/2005 | Chen | 473/479 |

* cited by examiner

*Primary Examiner*—Eugene Kim
*Assistant Examiner*—M. Chambers
(74) *Attorney, Agent, or Firm*—Clement Cheng

(57) ABSTRACT

The inflatable basketball structure includes an inflatable basketball backboard, an inflatable basketball rim, a basketball net, an inflatable supporting pole, and an inflatable safety enclosure. The inflatable basketball structure on a trampoline allows height challenged users the opportunity to slam-dunk and otherwise fulfill athletic basketball fantasies in a safe environment.

8 Claims, 6 Drawing Sheets

INFLATABLE BASKETBALL STRUCTURE

This application is a division of 10/651,897, filed Aug. 29, 2003 now U.S. Pat. No. 6,918,846.

DISCUSSION OF RELATED ART

Since the beginning of basketball, the slam dunk has been a popular athletic aspiration. Unfortunately, many people are unable to reach the rim. Although basketball is athletically demanding, some skills can be enhanced through a variety of devices.

Basketball assistance devices have been invented to make basketball easier and more fun. U.S. Pat. No. 5,833,557 to inventor Edward W. Cole discloses a two player trampoline basketball game structure with trampoline surfaces for basketballs to bounce within its framework. The structure provides trampolines for the basketballs assisting shots made by players. U.S. Pat. No. 5,967,911 to Oliver D. McAvoy shows a basket ball return used on a regular basketball court and placed under the basketball pole and net. This wedge shaped ramp allows a basketball to bounce back to the player after the ball goes through the net.

Trampolines have also assisted basketball players in reaching the rim. Unfortunately, trampoline injuries are very common and risk of injury increases when the game is played on a trampoline. A variety of devices have been invented to make trampolines and jumping safer. U.S. Pat. No. 4,875,548 to Peter Lorsbach shows jump rescue apparatus having a rebound surface made of tensioned fabric held in an inflatable tube framework. U.S. Pat. Nos. 6,053,845, 6,261,207 to Publicover shows an enclosure net and frame for a trampoline having eight steel poles. Unfortunately, a user may be injured when accidentally jumping into a pole. A variety of other similar net and webbing structures have been used to make trampolines safer.

OBJECT OF THE INVENTION

An inflatable basketball structure on a trampoline allows height challenged users the opportunity to slam-dunk and otherwise fulfill athletic basketball fantasies in a safe environment.

DETAILED DESCRIPTION OF THE PREFERRED EMBODIMENT

Figure 1:
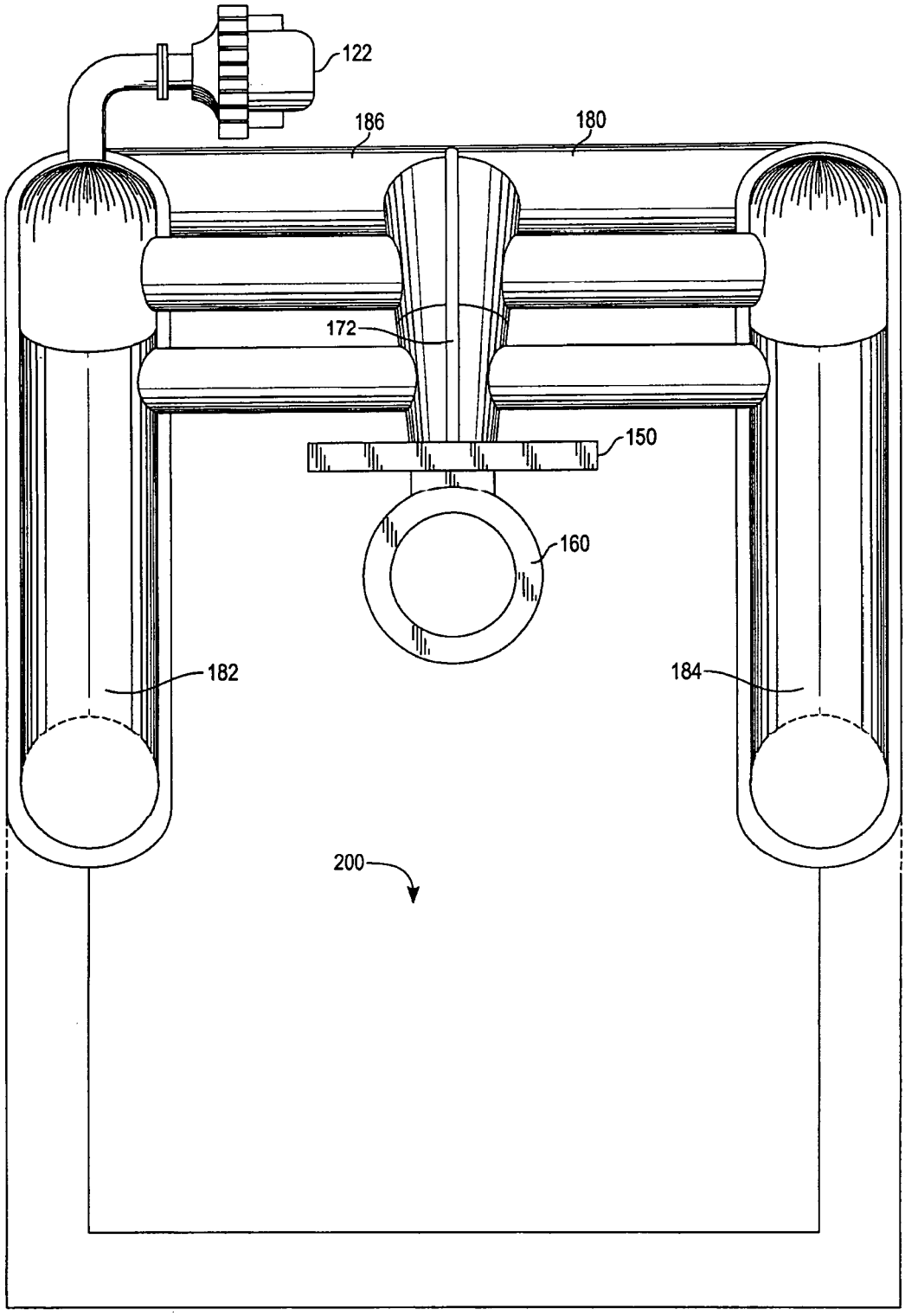
FIG. 1 is a top view of the basketball structure.
Figure 2:
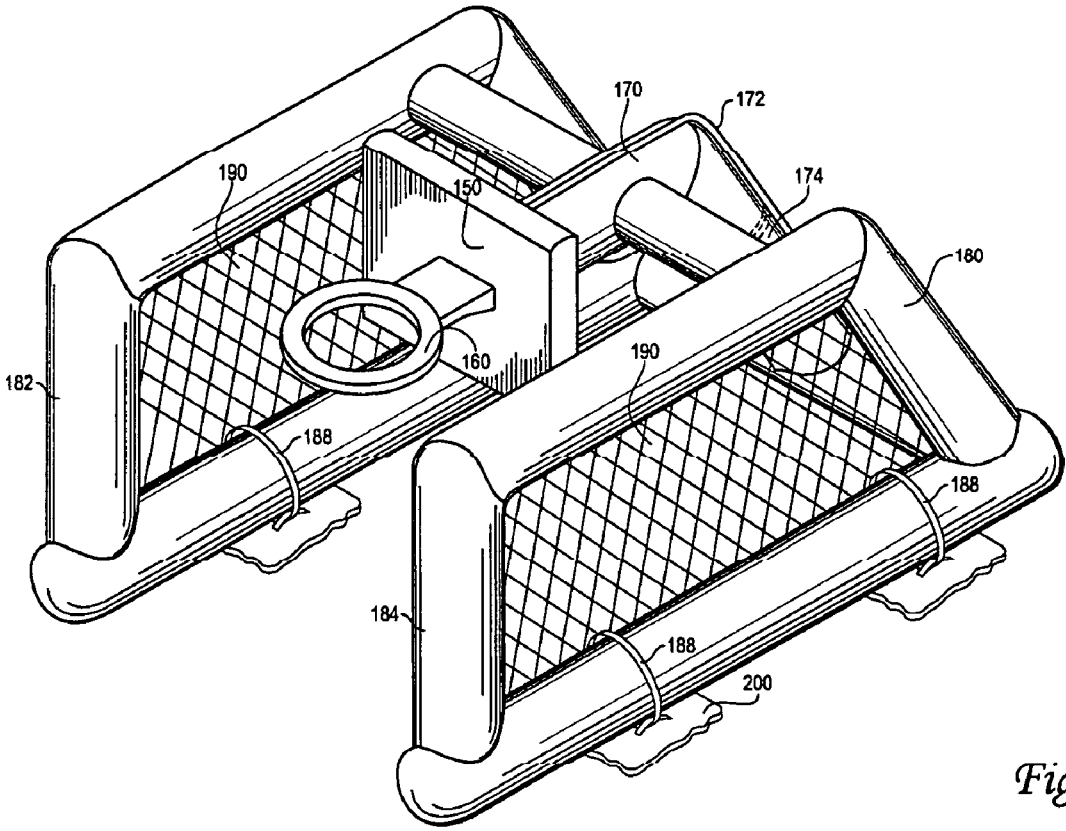
FIG. 2 is a perspective view of the basketball structure.

The inflatable basketball structure resembles an ordinary basketball apparatus and includes an inflatable basketball backboard 150, an inflatable basketball rim 160, a basketball net 162, an inflatable supporting pole 170, and an inflatable safety enclosure 180. FIG. 2. The members are made of one or more inflatable cells. Several members can be made of a single cell. Each individual inflatable cell has an airtight inflatable chamber having an inflation valve 230. The inflation valve 230 permits air to be introduced and removed from the chamber. Alternately, the airtight inflatable chamber can be outfitted with more than one valve 230, an inflation valve and a separate deflation valve where the inflation valve only inflates the chamber and the deflation valve only deflates the chamber. FIG. 1.

Figure 3:
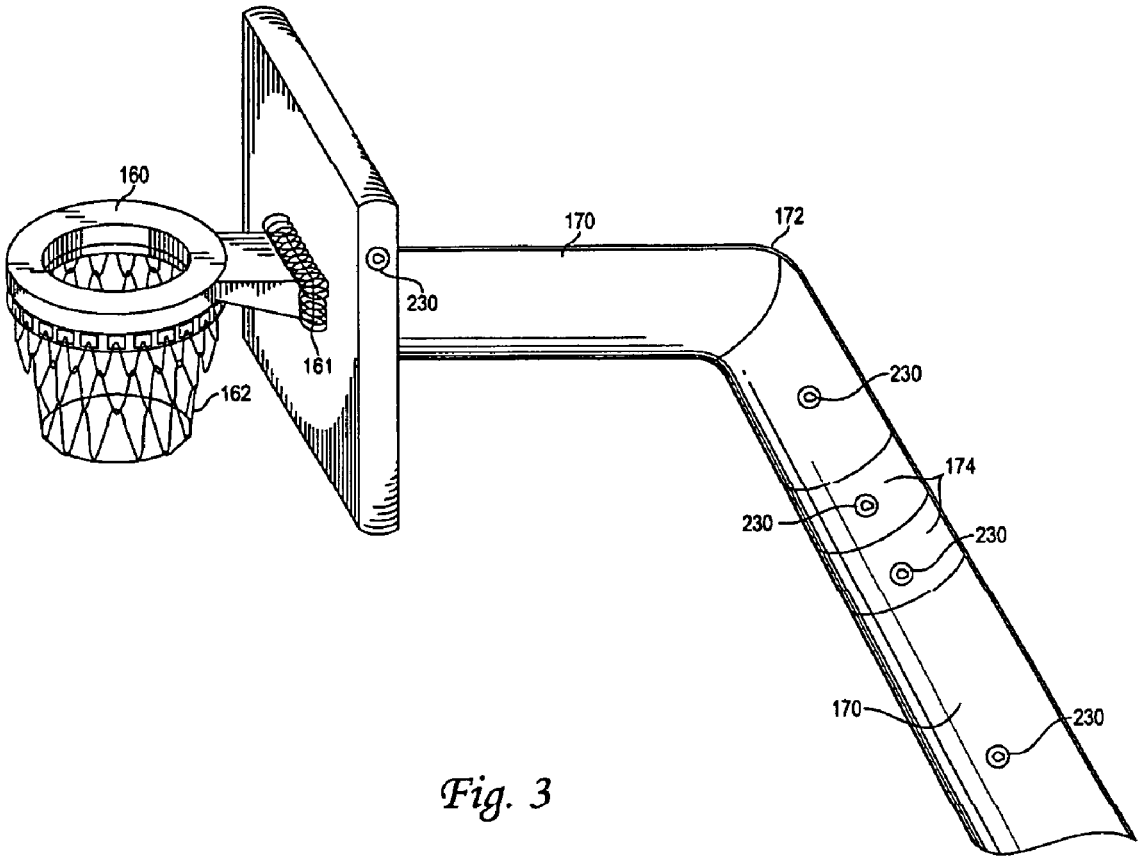
FIG. 3 is a rear view of the basketball structure.

Members may be formed of an outside jacket layer providing additional structural support as an exoskeleton for an inside inflatable member inflated against the outside jacket layer to prevent buckling of the outside jacket layer. 840D Nylon with PU coating or a 1100D PVC Tarpaulin with Polyester Substrate are typical semi rigid fabric materials. The inside inflatable member can be made of 0.35 mm PVC with plasticizer and can be regulated by a supplied air pressure regulating device and air pump. FIG. 3 The inflatable basketball backboard 150, inflatable basketball rim 160, basketball net 162, inflatable supporting pole 170, and inflatable safety enclosure 180 are formed of an outside jacket layer providing additional structural support as an exoskeleton for an inside inflatable member inflated against the outside jacket layer to prevent buckling of the outside jacket layer.

Basketball Basket

The basketball rim 160 is made of a hoop of inflatable or padded material. A standard basketball net 162 can be used on the inflatable basketball hoop 160 by attaching the net 162 to the hoop 160 by means of detachable hook and loop tape. The hoop 160 holds the net via the hook and loop tape where a hook side is disposed on either the net or hoop and the loop side is disposed on the other side. The net detaches if a user's fingers are caught in the net.

The rim is attached to the backboard. The junction between the hoop and the backboard is reinforced by elastic cord that restores the hoop 160 to neutral position after a user dunks on the hoop. Elastic cord 161 connects the backboard to the hoop. The rim is flexible in relationship to the backboard and can flex when a user slam dunks. The backboard is in turn attached to the backboard pole. The backboard 150 can be made of a single planar rectangular inflatable member.

The backboard 150 has an outside jacket layer restraining an inflated inside inflatable member. The outside jacket layer is a tough and more rigid fabric providing additional structural support as an exoskeleton. The inside inflatable backboard member is inflated against the outside jacket layer to prevent buckling of the outside jacket layer. The outside jacket layer restrains the inside inflatable member from expansion beyond the size of the outside jacket layer. Alternatively, the backboard can also be made of a planar rectangular rigid core enveloped on the rear side by an inflatable member.

Supporting Pole

The inflatable basketball pole 170 is hollow and inflatable. Optionally, the pole has an outside jacket layer restraining an inflated inside inflatable member. The outside jacket layer is a tough and more rigid fabric providing additional structural support as an exoskeleton. Again, 840D Nyon with PU coating or a 1100D PVC Tarpaulin with Polyester Substrate are typical semi rigid fabric materials. The inside inflatable member is inflated against the outside jacket layer to prevent buckling of the outside jacket layer. The inside inflatable member can be made of 0.35 mm PVC with plasticizer and can be regulated to 2 psi tolerance by a supplied air pressure regulating device and air pump. The outside jacket layer restrains the inside inflatable member from expansion beyond the size of the outside jacket layer. The inside inflatable member is an inflatable airtight member having an inflation valve. The member has a single inflation valve.

Figures 4, 5:
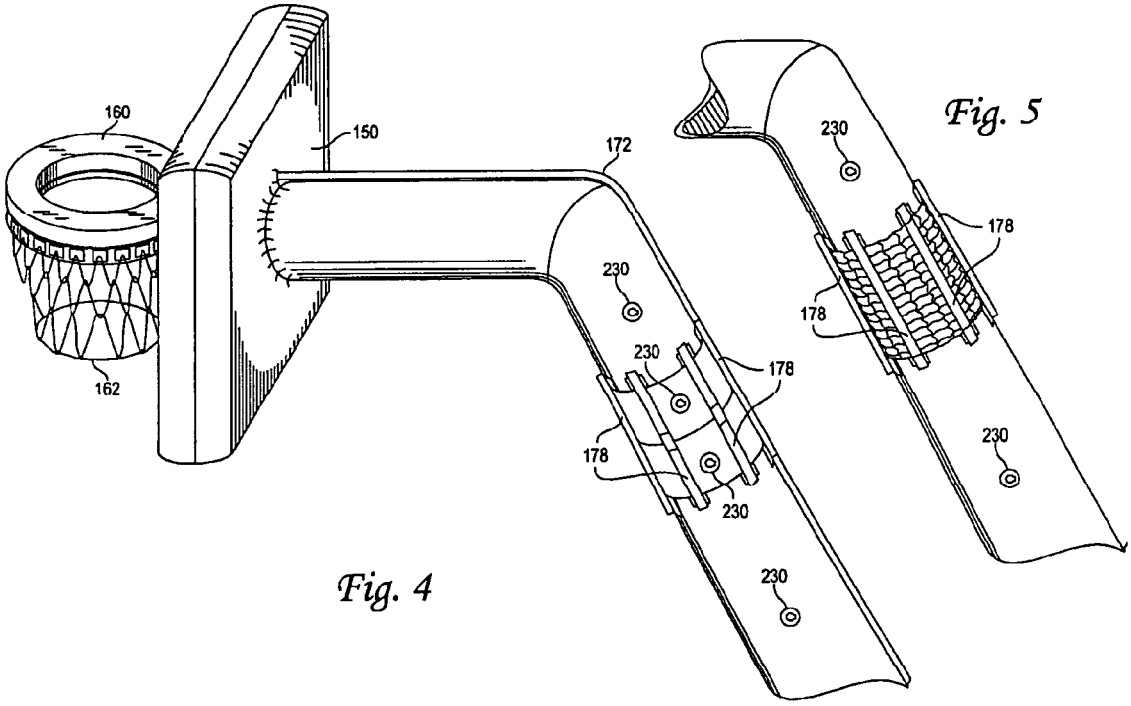
FIG. 4 is a side view of the basketball structure showing inflation chambers.
FIG. 5 is a side view of the basketball structure showing crumple zones.

The height adjustable pole can height adjust by either forming intermediate inflation chambers FIG. 4, 174 and FIG. 3, 174 or crumple zone FIG. 5, 176. In the first inflation chamber embodiment FIG. 4, 174, a number of intermediate independent chambers 174 have individual air inflation valves and form preferably a pair of independent inflation chambers. In the inflation chamber embodiment, the base portion of the inflatable basketball pole supports a number of independent chambers. The independent chambers in turn support the upper portion of the inflatable basketball pole. A user may inflate or deflate one or more of the chambers to raise or lower the height of the basketball hoop, rim, and backboard. Upon deflation of the independent chambers, the upper portion of the basketball pole decreases to a lower height, without affecting the air pressure of the base portion of the inflatable basketball pole or the upper portion of the inflatable basketball pole.

A user then secures the upper, lower and intermediate portions by pairs of upper and lower straps 178 of hook and loop tape. The upper and lower strap 178 maintains the relative position of the members in the inflation chamber 174 embodiment. The upper straps begin at a location above the upper intermediate inflation chamber 174 and secures to a corresponding lower strap 178 below the lowest intermediate inflation chamber 174. Buttons or other hardware attachment means may connect the straps 178 to each other. The preferred means for securing the opposing pair of straps 178 is hook and loop tape. Similarly, a user can increase the height of the basket by detaching the straps and inflating the intermediate chambers 174.

In the second basketball pole embodiment, FIG. 5 a crumble zone 176 is a user height adjustable section 176 of the basketball pole that allows a user to adjust the height of the basket. Unlike the inflation chamber embodiment, the crumble zone embodiment 176 has a single cell representing the basketball pole. The crumble zone 176 is a location on the basketball pole that can be deflated and restricted in height by a plurality of straps 178, or other restriction means, so that the zone does not inflate to full height when restricted by a height restriction means.

The crumble zone 176 is defined by height restriction means such as upper straps 178 that connect to lower straps 178. Upper straps connecting to lower straps allow partial inflation of the crumble zone 176. When the air pressure is at full inflation air pressure, the crumble zone 176 is also at full pressure. The crumble zone 176 deflates upon deflation of the entire enclosure.

Instead of straps 178, the sleeve representing the outside shell of the basketball pole can be modified to have height adjustable means. Common size adjustment means commonly used in shells of luggage applications include zippers closing a cascade of flaps to allow a user to zip up and contract selected portions of sleeves thus setting the full inflation height of the crumble zone. Here, a similar flap system can be used.

A user determines the desired height of the basket rim and can adjust straps and set the straps to the proper height. The proper height is marked on the straps. Once the straps are in place, the user inflates the device. The crumple zone straps 178 limit the total height of the basket rim while maintaining rigid inflation. The crumple zone 176 can be scored or prefolded to create a standard folding pattern that allows the zone 176 a specific repetitively formed shape instead of a random crumpled shape.

The net has hook and loop tape connecting the net 162 to the rim 160. The loop side is attached to the net 162 while the hook side is attached to the rim 160. If a user has a finger caught in the net, the net detaches to prevent injury to the user. The present embodiment further includes and an elastic cord 172 attaching the back of the backboard to the spine of the basketball pole. The spine is the rearward portion facing away from the face of the backboard. The elastic cord 172 restores the position of the backboard after a user dunks. The elastic cord 172 can be threaded through loops or a continuous sleeve stitched into the spine of the basketball pole. A plurality of elastic cords 172 may be used depending upon the restoring force desired. An elastic cord 172 connects the upper and lower portion in a similar manner and reinforces the hook and loop tape. The basketball pole has an outside covering that can be enveloped around the pole.

Enclosure

The crumple zone shares air pressure with the basketball pole and main wall members 182, 184, 186. An air pump 122 can assist in maintaining air pressure by providing air to the enclosure and the basketball pole. The air pump 122 is preferably attached to the base of the enclosure, constantly providing air input. The inflatable structure enclosure 180 retains a basketball inside the enclosure by mesh netting 190. Retaining the basketball enhances users safety and fun.

The three main wall members forming the enclosure includes the left wall 182, the right wall 184 and the rear wall 186. The standard wall consists of a top tubular member attached to a pair of side tubular members attached to a bottom tubular member. The four tubular members form a frame defining an aperture that is enclosed by netting stretched to span across the aperture. The inflatable basketball structure can be mounted on a trampoline with the left wall, right wall, and rear wall resting on the periphery of the rectangular trampoline. A rope or strap retains the enclosure to the trampoline frame and can attach the left wall 182, right wall 184 and rear wall 186 to the frame.

Figure 6A:
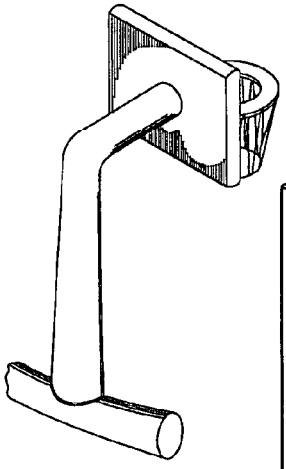
FIG. 6 is a perspective view of the basketball structure attached to a trampoline enclosure.
Figure 6B:
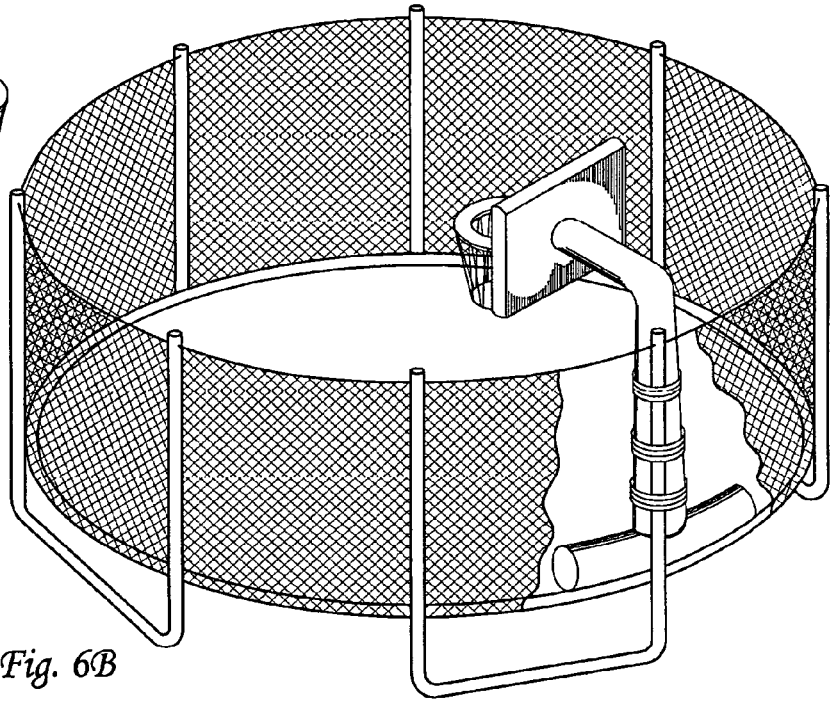

The preferred embodiment has a rectangular enclosure with three main walls. Alternate embodiments may use circular or semicircular wall configurations as shown in FIG. 6. A wall includes a structure of inflatable frame members with netting spanning between inflatable frame members.

In an alternate freestanding embodiment FIG. 5, FIG. 6, the basketball pole 170, basket and rim 160 are separately inflated from the enclosure 180. The assembly of the basketball pole, basket and rim forms a freestanding unit resting on the basketball pole base having no air communication with the protective enclosure 180. The freestanding inflatable pole 170 is attached to the protective enclosure 180 by mounting straps 188 or mounting cord 188 and can be reconfigured to attach to other structures by mounting straps 188 or a mounting cord 188.

The freestanding embodiment maximizes user configuration options and allows the basketball pole member 170 to be separated from the protective enclosure and attached to other non-inflated or inflated protective trampoline enclosures as shown in FIG. 5. Non-inflated protective trampoline enclosures having solid steel frames and retaining mesh netting are widely used. Some are described in U.S. Pat. Nos. 6,053,845, and 6,261,207 to Publicover. The freestanding inflatable pole can be attached to a wide variety of non-inflated structures by means of straps or cord.

The inflatable basketball structure may comprise an inflatable safety enclosure having three walls defining a semicircular instead of rectangular enclosure, and here the trampoline provided is a circular trampoline. The rear wall can be made of a frame formed by tube members or left without a mesh netting for an open appearance.

FIG. 6 is a perspective view of the basketball structure attached to a trampoline enclosure.

Figure 7:
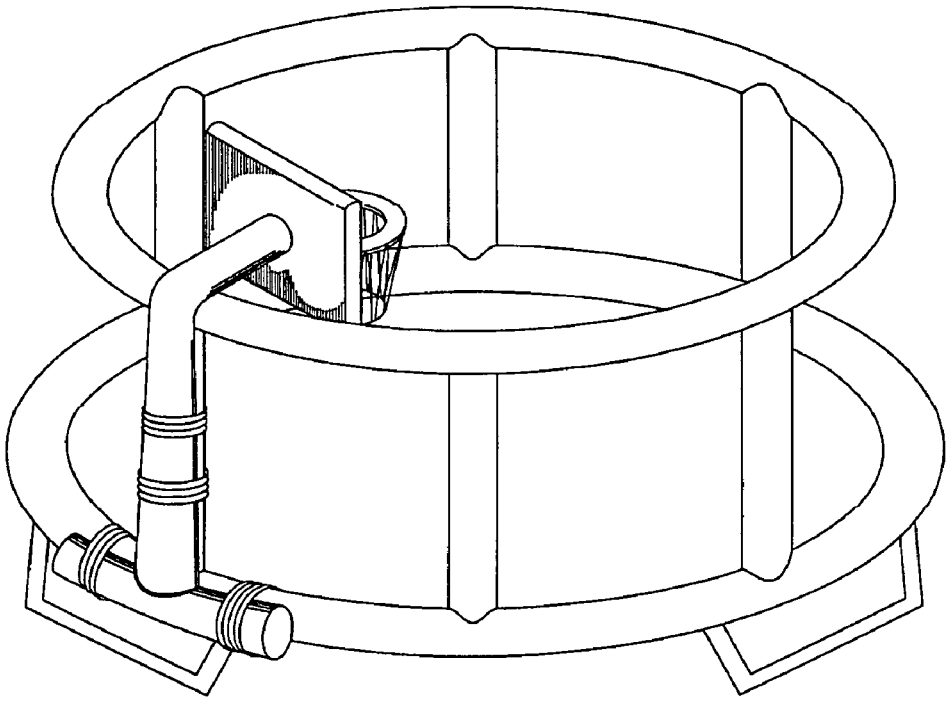
FIG. 7 is a perspective view of the basketball structure attached to a circular inflatable enclosure.

FIG. 7 is a perspective view of the basketball structure attached to a circular inflatable enclosure.

The invention claimed is:

1. An inflatable basketball structure comprising: a padded basketball hoop 160 ; an inflatable basketball backboard supporting the padded basketball hoop at a junction; a basketball net mounted from the padded basketball hoop; and an inflatable supporting pole supports the inflatable basketball backboard, wherein the padded basketball hoop and the inflatable backboard junction are reinforced by elastic cord that restores the basketball hoop to neutral position after a user dunks on the hoop.

2. The inflatable basketball structure of claim 1 wherein the inflatable basketball backboard, inflatable basketball rim, basketball net, and inflatable supporting pole, are formed of an outside jacket layer providing additional structural support as an exoskeleton for an inside inflatable member inflated against the outside jacket layer to prevent buckling of the outside jacket layer.

3. The inflatable basketball structure of claim 2 wherein the basketball net is detachably mounted to the basketball rim by hook and loop tape.

4. The inflatable basketball structure of claim 2 wherein the inflatable basketball backboard is a planar rectangular rigid core enveloped on the rear side by an inflatable member.

5. An inflatable basketball structure comprising: an inflatable basketball hoop; an inflatable basketball backboard supporting the inflatable basketball hoop at a junction; a basketball net mounted from the inflatable basketball hoop; and an inflatable supporting pole supports the inflatable basketball backboard, wherein the basketball pole is height adjustable by at least one intermediate inflation chamber defined between a base portion of the inflatable basketball pole and an upper portion of the inflatable basketball pole, wherein the at least one intermediate inflation chamber is retained against the base portion and upper portion.

6. The inflatable basketball structure of claim 5 wherein the inflatable basketball backboard, inflatable basketball rim, basketball net, inflatable supporting pole, and an inflatable safety enclosure are formed of an outside jacket layer providing additional structural support as an exoskeleton for an inside inflatable member inflated against the outside jacket layer to prevent buckling of the outside jacket layer.

7. The inflatable basketball structure of claim 6 wherein the basketball net is detachably mounted to the basketball rim by hook and loop tape.

8. The inflatable basketball structure of claim 6 wherein the inflatable basketball backboard is a planar rectangular rigid core enveloped on the rear side by an inflatable member.

* * * * *